US008210971B1

(12) United States Patent
Fulton

(10) Patent No.: US 8,210,971 B1
(45) Date of Patent: Jul. 3, 2012

(54) PIVOTING-BLADE DEEP-PENETRATION ARROWHEAD

(76) Inventor: Brett Fulton, North Huntingdon, PA (US)

( * ) Notice: Subject to any disclaimer, the term of this patent is extended or adjusted under 35 U.S.C. 154(b) by 522 days.

(21) Appl. No.: 12/388,372

(22) Filed: Feb. 18, 2009

Related U.S. Application Data

(60) Provisional application No. 61/030,039, filed on Feb. 20, 2008.

(51) Int. Cl.
*F42B 6/08* (2006.01)

(52) U.S. Cl. ..... 473/583

(58) Field of Classification Search ..... 473/583, 473/584

See application file for complete search history.

(56) References Cited

U.S. PATENT DOCUMENTS

| | | | | |
|---|---|---|---|---|
| 5,046,744 | A * | 9/1991 | Eddy | 473/583 |
| 5,172,916 | A | 12/1992 | Puckett | |
| 5,178,399 | A | 1/1993 | Garoutte | |
| 5,417,440 | A | 5/1995 | Barrie et al. | |
| 5,482,294 | A | 1/1996 | Sullivan | |
| 5,879,252 | A * | 3/1999 | Johnson | 473/583 |
| 6,171,206 | B1 * | 1/2001 | Liechty, II | 473/583 |
| 6,290,903 | B1 | 9/2001 | Grace et al. | |
| 6,306,053 | B1 * | 10/2001 | Liechty, II | 473/583 |
| 6,540,628 | B1 | 4/2003 | Musacchia, Jr. | |
| 6,595,881 | B1 | 7/2003 | Grace, Jr. et al. | |
| 6,669,586 | B2 | 12/2003 | Barrie | |
| 6,726,581 | B2 | 4/2004 | Muller | |
| 6,918,848 | B2 | 7/2005 | Kuhn | |
| 6,939,258 | B2 | 9/2005 | Muller | |
| 7,226,375 | B1 | 6/2007 | Sanford | |
| 7,422,533 | B1 * | 9/2008 | Johnson | 473/584 |
| 2002/0151394 | A1 | 10/2002 | Arasmith | |
| 2004/0074483 | A1 | 4/2004 | Kuhn | |
| 2006/0084535 | A1 * | 4/2006 | Kuhn | 473/583 |
| 2007/0161438 | A1 | 7/2007 | Fulton | |
| 2007/0243959 | A1 | 10/2007 | Grace | |

* cited by examiner

*Primary Examiner* — John Ricci
(74) *Attorney, Agent, or Firm* — QuickPatents, Inc,; Kevin Prince

(57) ABSTRACT

A broadhead for an archery arrow is disclosed. The broadhead includes a substantially cylindrical body having a forward cutting end, a rearward attachment end, and a side wall. The forward cutting end terminates in a point and further includes a plurality of pointed faces, each of which has a concave scoop formed therein. A cutting edge is formed between each pointed face. The side wall of the body, in one embodiment, includes a plurality of longitudinal slots. The broadhead in such an embodiment further includes a plurality of blades each having a forward cutting edge and preferably a rearward cutting edge. Each edge meets at a distal point. Each blade further includes a slot engaging edge opposite the distal point, and each blade may be pivotally fixed in one slot.

8 Claims, 3 Drawing Sheets

PIVOTING-BLADE DEEP-PENETRATION ARROWHEAD

CROSS-REFERENCE TO RELATED APPLICATIONS

This application claims the benefit of U.S. Provisional Patent Application 61/030,039, filed on Feb. 20, 2008, and incorporated herein by reference.

STATEMENT REGARDING FEDERALLY SPONSORED RESEARCH AND DEVELOPMENT

Not Applicable.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by any one of the patent disclosure as it appears in the Patent and Trademark Office patent files or records, but otherwise reserves all copyright and trade dress rights whatsoever.

FIELD OF THE INVENTION

This invention relates to arrowheads, and more particularly to a deep-penetrating snagless/non-barbing arrowhead.

DISCUSSION OF RELATED ART

Archery arrows used for game hunting typically have broadheads designed for increasing penetration of the arrow and maximizing cutting of animal matter, so as to quickly and humanely dispatch the game. Many such broadheads include detachable blade elements that can be replaced if dulled or worn. For example, US Patent Application 2007/0243959 to Grace on Oct. 18, 2007 teaches such a device. Further, many such broadheads include a forward cutting point that is formed from forming three or more tapered planes in the ferrule or body. For example, the Grace device shows such a leading cutting point, as does US 2004/0074483 to Kuhn on Apr. 22, 2004; and US 2002/0151394 to Arasmith on Oct. 17, 2002; and U.S. Pat. No. 6,540,628 to Musacchia, Jr. on Apr. 1, 2003; and U.S. Pat. No. 5,482,294 to Sullivan et al. on Jan. 9, 1996.

Sullivan teaches that such forward planes or faces may advantageously be curved or formed with a radius, for the purpose of effectively lengthening a cutting edge at the intersection of two such faces (col. 10, lines 1-5). However, Sullivan does not teach forming such curved indentations in such faces completely within the faces and not extending them to the cutting edges, which maintains a consistent cutting edge length but forms a lobe or concave portion that results in an effective deflecting structure that deflects air and animal matter away from the trailing blades. Such a reduced size indentation, particularly one that is convexly shaped and formed to aggressively deflect air and animal matter away from the longitudinal axis of the body and the blades both increases penetration of the broadhead into game and increases accuracy, particularly in a strong cross-wind.

Penetration ability of a broadhead is therefore an important factor for quickly dispatching game through increased tissue damage. Another important factor is the amount of tissue damage that results from the broadhead being removed from game. When the prior art broadheads become lodged inside the animal without causing sufficient damage to immediately bring the game down, such game can run off and possibly escape. In such situations, if the animal by brushing up against trees or rocks, manages to break-off the arrow or otherwise eject the arrow from its body, it has a greater chance of escape if sufficient damage was not done with the initial arrow strike. Providing blades that cut in both forward an backward directions, therefore, can increase the tissue damage done to the animal as the animal is trying to escape, and thus increase the chance that the game will be ultimately brought down and located quickly. Other than the device taught in my co-pending US Patent Application 2007/0161438, prior art blades do not provide for a rear cutting surface. However, the blades of my prior device have a tendency to snag when the arrow is pulled out of the game.

Therefore, there is a need for an archery broadhead that more aggressively forces air and animal matter away from the longitudinal axis of the arrow and the blades, thereby increasing penetration and shot accuracy. Such a needed device would further provide for blades having both forward and rearward cutting edges for maximizing tissue damage when the broadhead travels in both forward or backward directions in the animal. Such rearward cutting blades would further facilitate removal of the arrow from game. To prevent such a rearward cutting blade from getting snagged, the blades would rotate so that the distal points of the blade trail the cutting edges thereof. The present invention accomplishes these objectives.

SUMMARY OF THE INVENTION

The present device is a broadhead for an archery arrow. The broadhead includes a substantially cylindrical body having a forward cutting end, a rearward attachment end, and a side wall. The forward cutting end terminates in a point and further includes a plurality of pointed faces, each of which has a concave scoop formed therein. A cutting edge is formed between each pointed face. The side wall of the body, in one embodiment, includes a plurality of longitudinal slots.

The broadhead in such an embodiment further includes a plurality of blades each having a forward cutting edge and preferably a rearward cutting edge. Each edge meets at a distal point. Each blade further includes a slot engaging edge opposite the distal point, and each blade may be pivotally fixed in one slot.

The present invention is an archery broadhead that aggressively forces air and animal matter away from the longitudinal axis of the arrow and the blades as the arrow travels, thereby increasing penetration and shot accuracy. The present invention further provides blades having both forward and rearward cutting edges for maximizing tissue damage regardless of travel direction inside the animal. Such rearward cutting blades further facilitate removal of the arrow from game. Further, the blades of the present invention rotate or pivot forward so that the distal point of each blade trails the cutting edges thereof, reducing the tendency of the broadhead to snag on bone or other difficult-to-cut matter. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
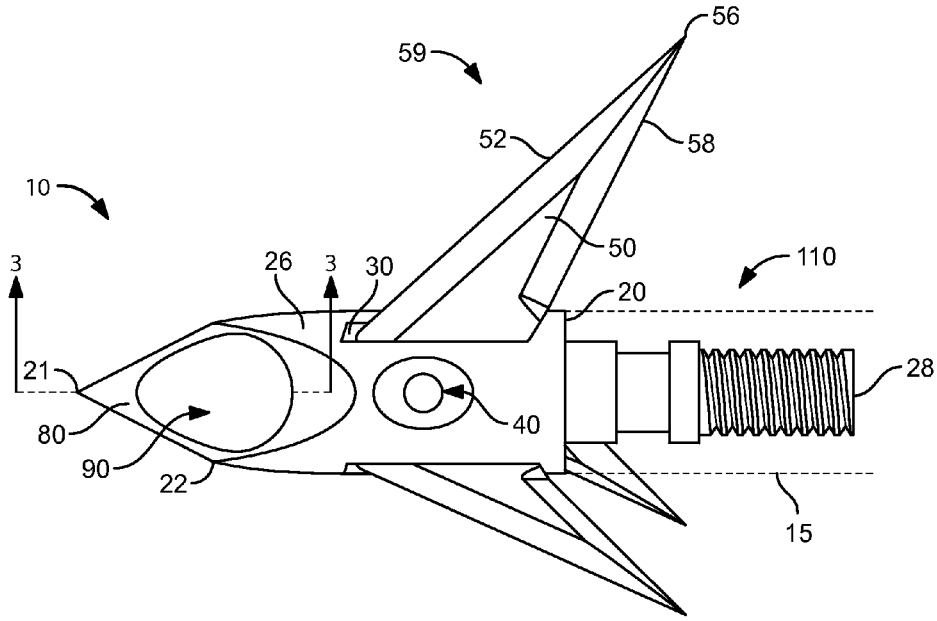
FIG. 1 is an elevational view of one embodiment of the invention.
Figure 2:
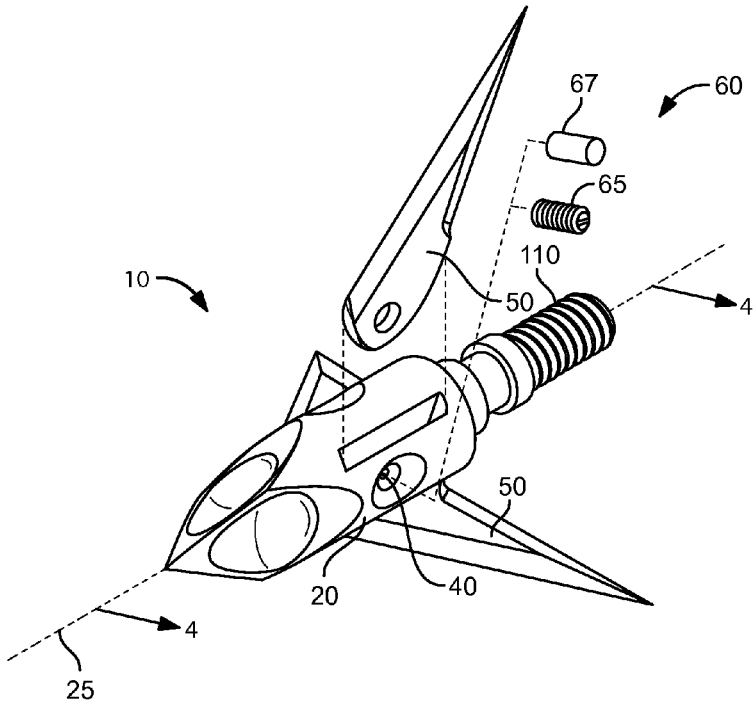
FIG. 2 is a perspective view thereof.

FIGS. 1 and 2 illustrate a broadhead 10 for an archery arrow 15. The broadhead 10 includes a substantially cylindrical body 20 having a forward cutting end 22, a rearward attachment end 28 having an arrow attachment means 110, and a side wall 26. The arrow attachment means 100 is, for example, a threaded shaft 115 for engaging a threaded bore (not shown) of the arrow 15, or the like.

Figure 3:
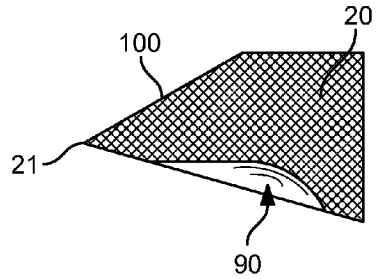
FIG. 3 is a cross-sectional view thereof, taken generally along lines 3-3 of FIG. 1.
Figure 8:
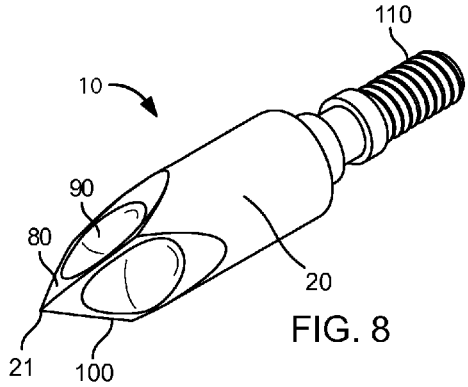
FIG. 8 is a bladeless embodiment of the invention.

The forward cutting end 22 terminates in a point 21 and further includes a plurality of pointed faces 80, each of which has a concave scoop 90 (FIGS. 2 and 3) formed therein. A cutting edge 100 is formed between each pointed face 80. Preferably three pointed faces 80 and concave scoops 90 are included in the forward cutting end 22, where each concave scoop and cutting edge are noncontiguous as illustrated. Such a body 20 is made from stainless steel, for example, or other suitably rigid material that can hold a sharp point 21 and cutting edge 100. A bladeless embodiment of the invention is illustrated in FIG. 8.

Figure 5:
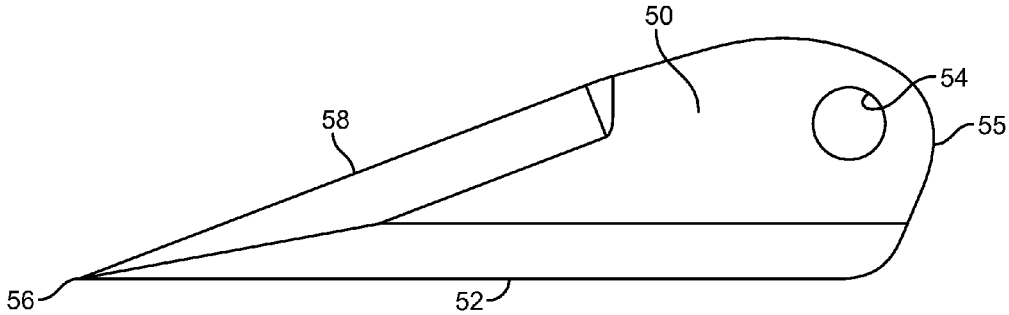
FIG. 5 is a perspective view of a blade of the invention.
Figure 6:
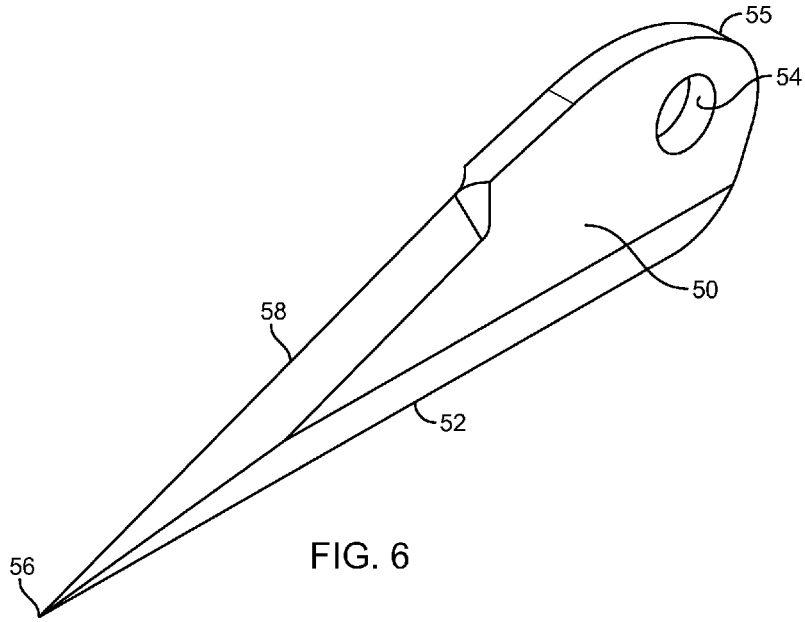
FIG. 6 is an elevational view thereof.

The side wall 26 of the body 20, in one embodiment, includes a plurality of longitudinal slots 30, each having a fastener aperture 40 associated therewith. The broadhead 10 in such an embodiment further includes a plurality of blades 50 (FIGS. 5 and 6) each having a forward cutting edge 52 and preferably a rearward cutting edge 58. Each edge 52,58 meets at a distal point 56. Each blade 50 further includes a slot engaging edge 55 opposite the distal point 56 and having a fastener aperture 54 that is coalignable with the fastener aperture 40 of any of the plurality of slots 30 when the blade 50 is inserted into the slot 30. A plurality of fasteners 60 are included for fixing each blade 50 in one slot 30 at the fastener apertures 40. Such fasteners 60 may be, for example, set screws 65 or threadless shafts 67 (FIG. 2) that are frictionally held within each fastener aperture 40, or the like. Each blade 50 may be made of stainless steel, for example, or other suitably rigid material.

Figure 7:
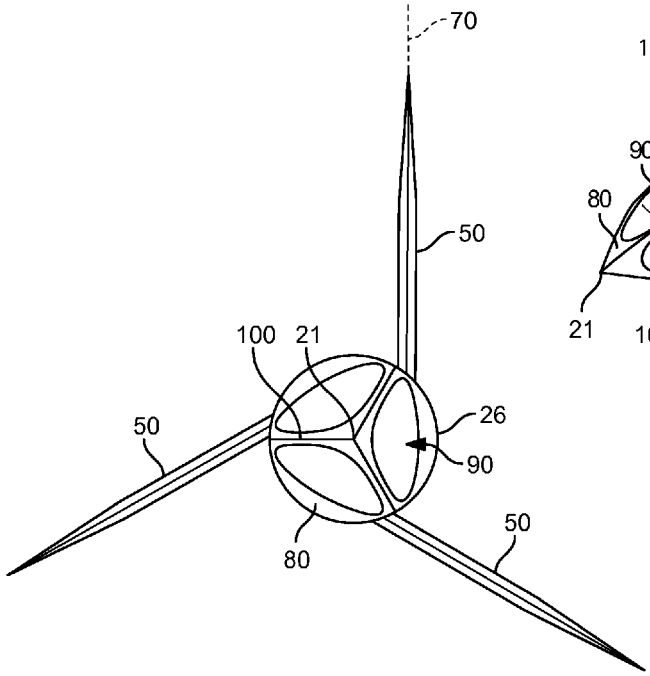
FIG. 7 is a front elevational view of the invention.

In one embodiment, the plurality of blades 50 is exactly three blades 50, and each longitudinal slot 30 defines a blade plane 70 that each blade 50 substantially incorporates. Each blade plane 70 is offset from the longitudinal axis 25 of the body 20 (FIG. 7). As such, as the broadhead 10 travels through air and, for example, animal matter (not shown), the concave scoop 90 of each pointed face 80 ejects such air or matter away from the longitudinal axis 25 of the body and each blade 50.

Figure 4:
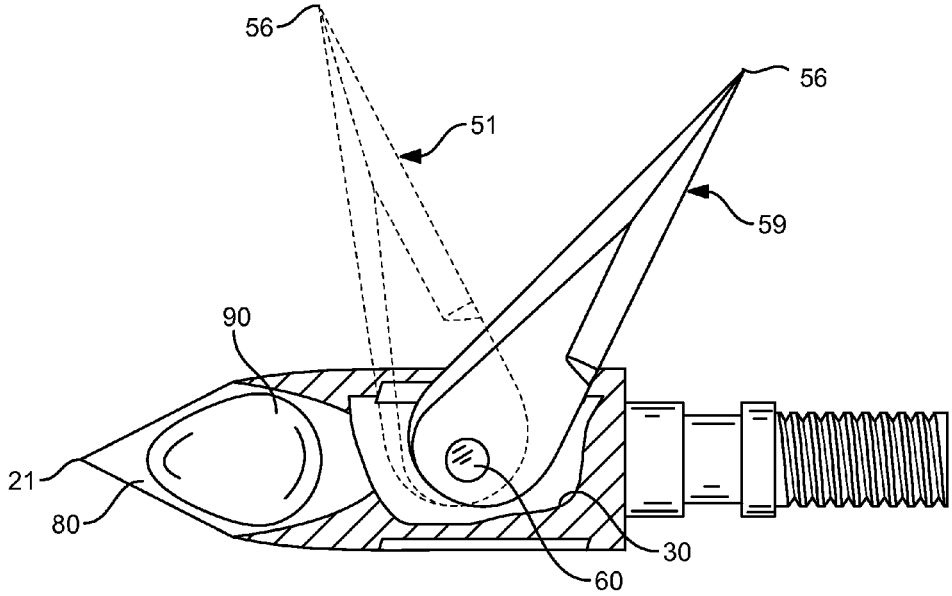
FIG. 4 is a cross-sectional view of the invention, taken generally along lines 4-4 of FIG. 2.

In one embodiment, the slot engaging edge 55 of each blade 50 is curved such that the blade 50 may pivot in the longitudinal slot 30 around the fastener 60 between a forward position 51 (FIG. 4) wherein the distal point 56 of the blade 50 is longitudinally in front of the fastener aperture 54 of the blade 50, and a rearward position 59 wherein the distal point 56 of the blade 50 is longitudinally behind the fastener aperture 54 of the blade 50.

While a particular form of the invention has been illustrated and described, it will be apparent that various modifications can be made without departing from the spirit and scope of the invention. For example, the illustrations show an embodiment having three of the pointed faces 80. However, other embodiments having four, five, six or more pointed faces 80 may be included. Accordingly, it is not intended that the invention be limited, except as by the appended claims.

The teachings provided herein can be applied to other systems, not necessarily the system described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

These and other changes can be made to the invention in light of the above Detailed Description. While the above description details certain embodiments of the invention and describes the best mode contemplated, no matter how detailed the above appears in text, the invention can be practiced in many ways. Details of the system may vary considerably in its implementation details, while still being encompassed by the invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventor contemplates the various aspects of the invention in any number of claim forms.

Accordingly, the inventor reserves the right to add additional claims after filing the application to pursue such additional claim forms for other aspects of the invention.

What is claimed is:

1. A broadhead comprising:

a substantially cylindrical body having a forward cutting end, a rearward attachment end having an arrow attachment means, and a side wall, the forward cutting end terminating in a point and further including a plurality of pointed faces, each face including a concave scoop formed therein, a cutting edge being formed between each pointed face, where each concave scoop and cutting edge are noncontiguous.

2. The broadhead of claim 1 wherein the side wall includes a plurality of longitudinal slots, each having a fastener aperture, the broadhead further including a plurality of blades each having a forward cutting edge, a rearward cutting edge, each cutting edge meeting at a distal point, each blade further including a slot engaging edge opposite the distal point and having a fastener aperture coalignable with the fastener aperture of any of the plurality of slots; the broadhead further including a plurality of blade fasteners for fixing each blade in one of the longitudinal slots at the fastener apertures.

3. The broadhead of claim 2 wherein the plurality of blades is exactly three, and wherein each longitudinal slot defines a blade plane, each blade plane offset from the longitudinal axis of the body.

4. The broadhead of claim 3 wherein the slot engaging edge of each blade is curved such that the blade may pivot in the longitudinal slot around the fastener between a forward position wherein the distal point of the blade is longitudinally in front of the fastener aperture of the blade, and a rearward position wherein the distal point of the blade is longitudinally behind the fastener aperture of the blade.

5. The broadhead of claim 3 wherein each blade fastener is a set screw.

6. The broadhead of claim 3 wherein each blade fastener is a threadless shaft frictionally held within each fastener aperture of the body.

7. The broadhead of claim 3 wherein the body and each blade is made from stainless steel.

8. The broadhead of claim 1 wherein the arrow attachment means is a threaded shaft for engaging a threaded bore of the arrow.

* * * * *